United States Patent [19]

Clark

[11] 4,291,848

[45] Sep. 29, 1981

[54] MISSILE SEEKER OPTICAL SYSTEM

[75] Inventor: Keith E. Clark, China Lake, Calif.

[73] Assignee: The United States of America as represented by the Secretary of the Navy, Washington, D.C.

[21] Appl. No.: 506,499

[22] Filed: Sep. 13, 1974

[51] Int. Cl.[3] ..... F41G 7/26

[52] U.S. Cl. ..... 244/3.16

[58] Field of Search ..... 244/3.15, 3.16, 3.17, 244/3.18; 250/203 R; 350/285

[56] References Cited

U.S. PATENT DOCUMENTS

| | | | |
|---|---|---|---|
| 3,729,152 | 4/1973 | Stephenson | 244/3.16 |
| 3,756,538 | 9/1973 | McLean | 244/3.16 |
| 3,887,263 | 6/1975 | Thompson | 250/203 R |

*Primary Examiner*—Charles T. Jordan

*Attorney, Agent, or Firm*—R. S. Sciascia; W. Thom Skeer; Gerald F. Baker

[57] ABSTRACT

A missile seeker optical system which provides off-boresight viewing angles up to 135° by the addition of two spherical-toric corrector lenses which cooperate with a conventional achromatic lens used as the seeker objective.

6 Claims, 6 Drawing Figures

MISSILE SEEKER OPTICAL SYSTEM

BACKGROUND OF THE INVENTION

The present invention relates to a missle seeker system and particularly to a missle seeker optical system which will extend the effective look angle of the missile seeker objective.

The smaller the look angle, the smaller the acquisition envelope. In other words, with a look angle of only 90° the pilot must point the aircraft to acquire a target. When the missile seeker look angle is increased up to 135° off-boresight, pointing of the aircraft is not so critical and target acquisition is greatly enhanced.

Missile technology has progressed to the point where a gimbal arrangement allows the missile objective to cover a range larger then a hemisphere. Accordingly, a portion of the nose of the missile behind the hemispherical nose dome has been made transparent to take advantage of this greater flexibility. It has been found, however, that the different optical parameters encountered by the radiation passing through the non-spherical portion of the window, would, in some cases, be so distorted as to be practically worthless.

According to the present invention an optical correction system is provided for dome astigmatism with a minimum number of optical surfaces which may be easily fabricated. This optical system uses a wedge angle in the conical portion of the dome to provide some of the optical correction. The forward end of the conical portion has a thickness identical to the spherical section and the inner and outer surfaces of the conical portion are tangent to the inner and outer surfaces respectively of the spherical portion. This results in a very good quality image with a minimum number of optical surfaces. With the addition of two corrector lenses on the gimbal fork the image seen through the conical portion of the dome is of a quality nearly identical to that seen through the spherical portion of the dome.

DESCRIPTION AND OPERATION

Figure 1:
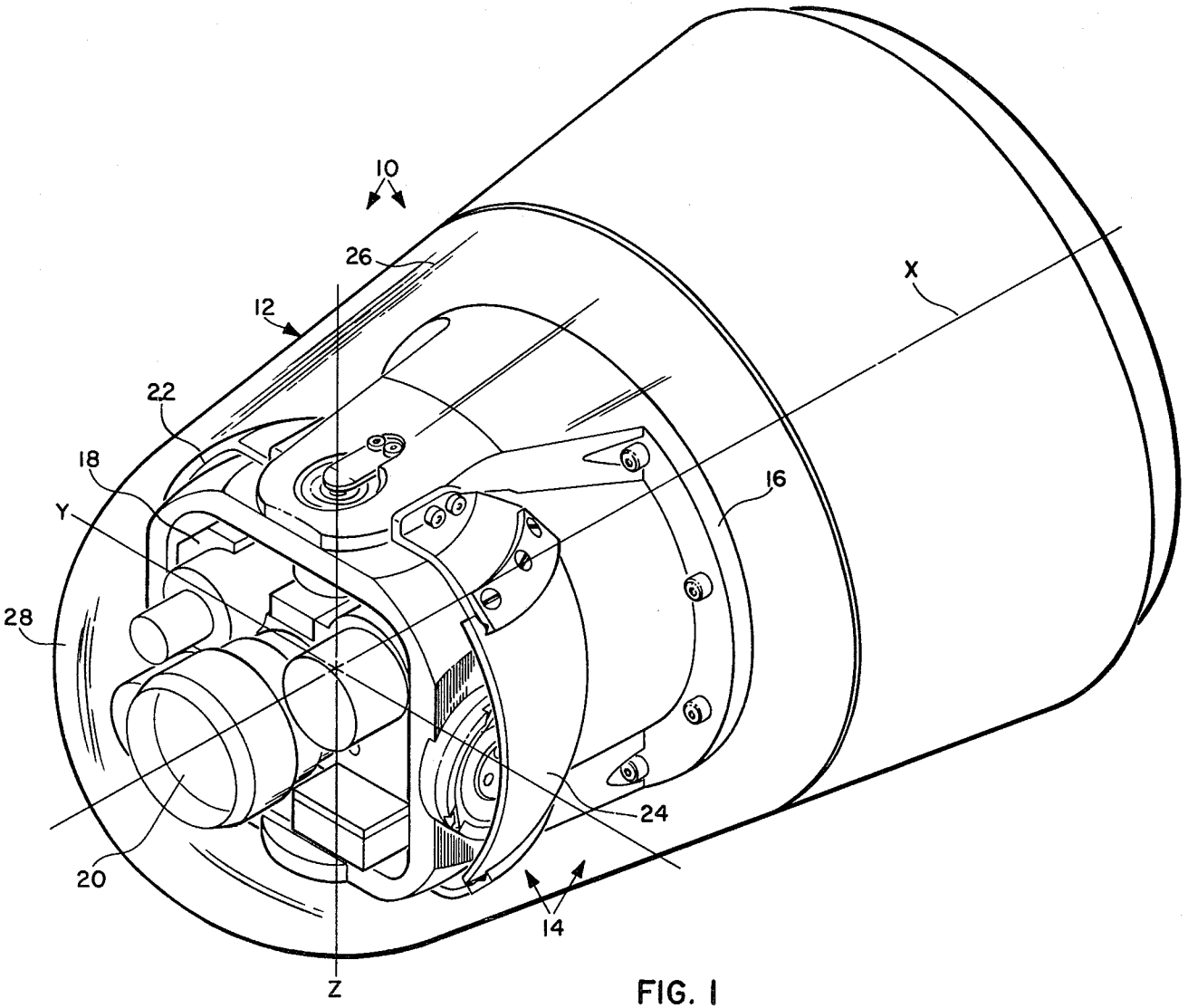
FIG. 1 is an isometric view of the nose of a missile incorporating the optical system according to the invention.

The missile seeker system for which this optical system is designed is indicated generally by the numeral 10 in FIG. 1. The nose of the missile is a sphero-conical dome 12 of silica glass, for example, such as Corning No. 7913 ($n_D$=1.459). The seeker mechanism 14 inside of dome 12 comprises a gimbal fork 16 which is revoluble about the seeker roll axis (x) and a seeker platform 18 mounted on the gimbal fork for two degrees of freedom around a pitch axis (y) and a yaw axis (z). A seeker objective lens 20 is mounted on the seeker platform 18 for forming an image on a sensor (not shown) for tracking a target. The objective lens may be a conventional achromat.

Two spherical-toric corrector lenses 22, 24 are mounted on the seeker gimbal fork 16 and, when the objective lens is adjusted with the platform pointed at the conical portion of the transparent dome, light rays pass through the dome and then one of the corrector lenses before reaching the objective. The conical portion 26 of the dome has considerable astigmatism which is compensated for in the corrector lenses by shaping the ray beam with a spherical inner surface and a toric outer surface. The combined conical dome and corrector lens has the same optical power as the spherical portion 28 of the dome, so focus is maintained. The conical portion 26 of the dome is made thinner at the back giving a wedge angle (see FIG. 2) to keep the focus in close adjustment. This requires a suitable correlative or corresponding wedge angle in the corrector lens to prevent a double image at the sphere-cone transition region around point 30.

Figure 2:
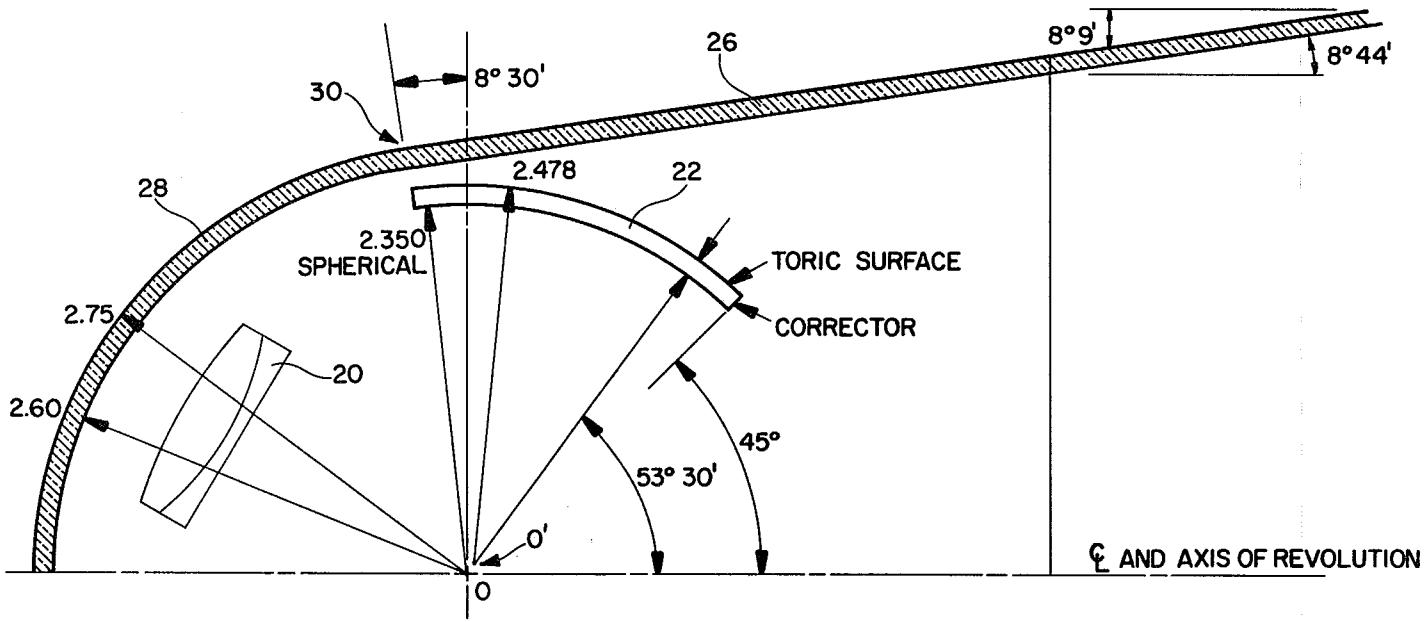
FIG. 2 is a schematic view of a portion of the missile seeker dome.

The relationship between the dome, the achromatic lens and the corrector lens is shown in FIG. 2. It can be seen that the inner and outer cone angles are different. That is to say, the conical portion 26 of the seeker window tapers in thickness from front to rear. Both inner and outer cone surfaces are tangent to the spherical surfaces of the portion 28 at the point of attachment 30.

The corrector lenses 22, 24 have spherical inner surfaces (Rs=2.35) and the outer surfaces are toric with a center of revolution 0.032 inches from dome center of curvature 0 along a line 53° 30′ from the center line indicated in FIG. 2. RT in the plane of the drawing is 2.478 and the toric radius of curvature in a plane perpendicular to the drawing, ($R_{T1}$) is 2.405.

Figure 3:
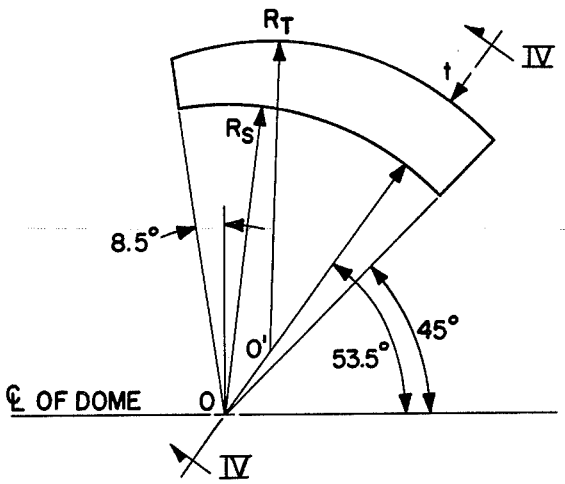
FIG. 3 is an enlarged cross sectional view of the corrector lens taken in a plane perpendicular to the yaw axis and with the curved surfaces slightly exaggerated.
Figure 4:
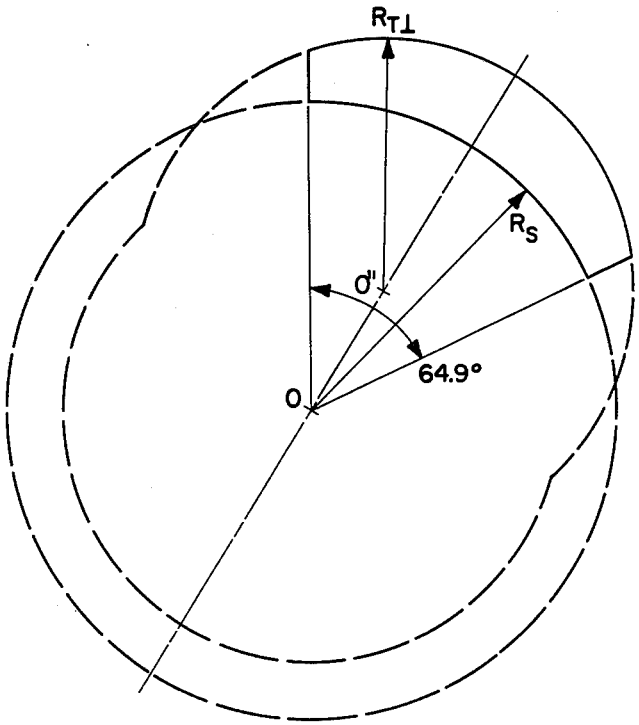
FIG. 4 is a longitudinal cross sectional view of the corrector lens taken along line IV-IV in FIG. 3.

In order to dramatize the shape of the surfaces of the corrector lenses, a diagrammatic cross sectional view of the lens with the circular and toric curvatures exaggerated is shown in FIG. 3. A similar view in FIG. 4 shows a section through line IV-IV of FIG. 3.

Figure 5:
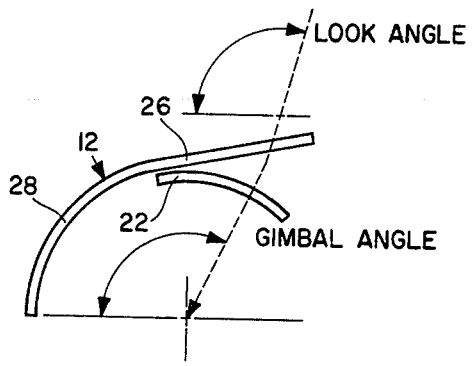
FIG. 5 is a schematic cross sectional view illustrating a look angle through the conical portion of the dome.
Figure 6:
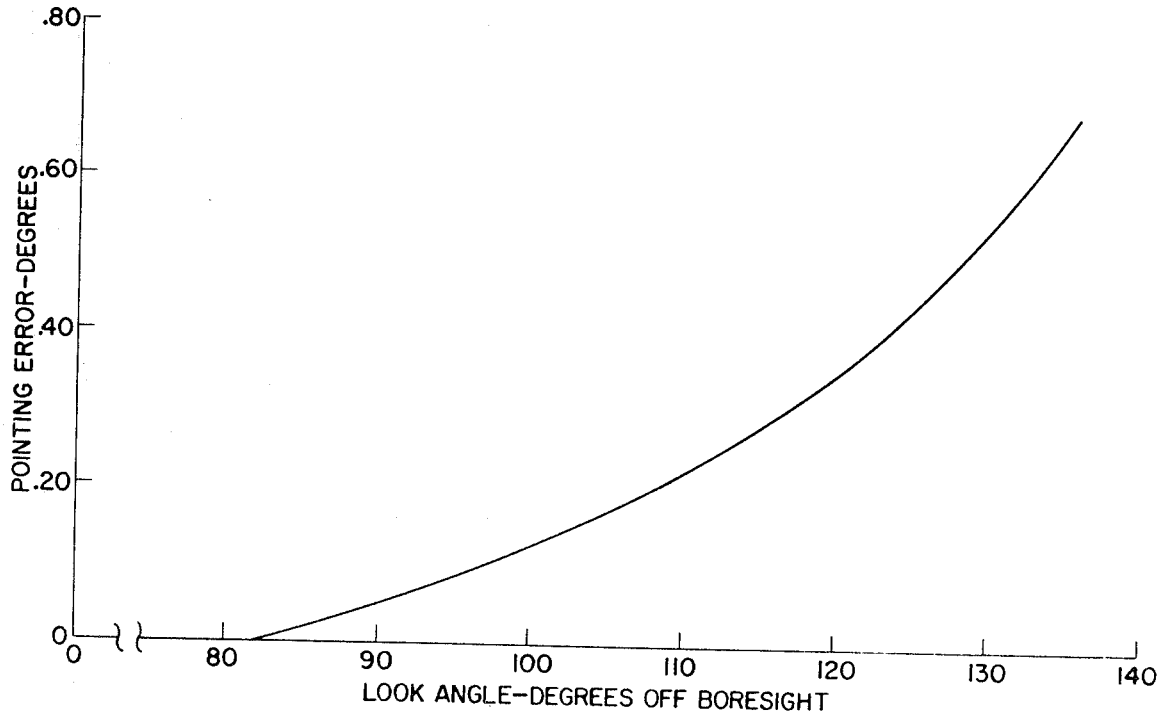
FIG. 6 is a graph of the pointing error with respect to the look angle through the conical portion of the dome.

FIG. 5 is a graphic illustration showing light rays passing through the conical portion of the dome and the corrector lens at a large look angle and FIG. 6 is a graph showing the pointing error in degrees as the look angle progresses from the transition point to its maximum extent. Pointing error equals gimbal angle minus look angle.

A critical aspect in design of a sphero-conical dome for Electro-optical use is maintaining the image across the transition zone. The dome wedge angle gives an image shift which would cause loss of lock at the transition zone. The corrector lens is designed with an opposite wedge angle at the transition point so that a double image is not formed. These wedge angles must be accurately matched to avoid a double image. At look angles through the remainder of the conical part of the dome the image gradually shifts until the seeker look angle is 135° with the second axis rotated to 135.68°. This angle shift is shown as a function of look angle in FIG. 6. This causes no trouble during tracking operation, but may require modification of sighting devices such as the helmet mounted sight (HMS) in the coordinate transformation for acquisition at angles greater than 80 degrees off-boresight.

I claim:

1. In a guided missile seeker system including; a dome window, a gimbal mechanism fixed within said dome window, an objective lens mounted on said gimbal mechanism for movement in three degrees of freedom through an angle greater than 90°, and detector means receiving radient energy passing through said dome window and said objective lens, the improvement comprising:

said dome window being formed by a spherical portion and a conical portion;

said conical portion having inner and outer surfaces tangent to inner and outer surfaces respectively of said spherical portion at the point of attachment thereof and said surfaces of said conical portion being tapered from said point of attachment rearwardly to a thinner aft end; and corrector lenses fastened to said gimbal mechanism and covering the area scanned by said objective lens when the objective lens is looking throughout the conical portion of the dome.

2. The system of claim 1 including said corrector lenses each having a spherical inner surface and toric outer surface.

3. The system of claim 2 further including said inner and outer surfaces of said corrector lenses having a predetermined wedge angle at the transition point between said spherical portion and said conical portion of said dome.

4. The system of claim 2 further including said inner and outer surfaces of said corrector lenses having a wedge angle at said transition point equal and opposite to the wedge angle between surfaces of said conical portion.

5. The system of claim 1 further including said inner and outer surfaces of said corrector lenses having a predetermined wedge angle at the transition point between said spherical portion and said conical portion of said dome.

6. The system of claim 5 further including said inner and outer surfaces of said corrector lenses having a wedge angle at said transition point equal and opposite to the wedge angle between surfaces of said conical portion.

* * * * *